US006106095A

United States Patent [19]

Jackson et al.

[11] Patent Number: 6,106,095

[45] Date of Patent: Aug. 22, 2000

[54] MAILING MACHINE HAVING REGISTRATION OF MULTIPLE ARRAYS OF PRINT ELEMENTS

[75] Inventors: Jerome E. Jackson, Newtown; Sung-won Moh, Wilton, both of Conn.

[73] Assignee: Pitney Bowes Inc., Stamford, Conn.

[21] Appl. No.: 08/951,075

[22] Filed: Oct. 15, 1997

[51] Int. Cl.[7] ..... B41J 29/393

[52] U.S. Cl. ..... 347/19

[58] Field of Search ..... 347/5, 12, 14, 347/19, 20, 40

[56] References Cited

U.S. PATENT DOCUMENTS

| | | | |
|---|---|---|---|
| 5,121,471 | 6/1992 | Nam | 395/115 |
| 5,128,691 | 7/1992 | Millet et al. . | |
| 5,250,956 | 10/1993 | Haselby et al. . | |
| 5,276,467 | 1/1994 | Meyer et al. . | |
| 5,289,208 | 2/1994 | Haselby . | |
| 5,297,017 | 3/1994 | Haselby et al. . | |
| 5,321,436 | 6/1994 | Herbert . | |
| 5,404,020 | 4/1995 | Cobbs | 250/548 |
| 5,442,383 | 8/1995 | Fuse | 347/19 |
| 5,451,990 | 9/1995 | Sorenson et al. | 347/37 |
| 5,530,460 | 6/1996 | Wehl | 347/19 |
| 5,534,895 | 7/1996 | Lindenfelser et al. | 347/19 |
| 5,568,172 | 10/1996 | Cowger | 347/19 |
| 5,596,353 | 1/1997 | Takada et al. | 347/19 |
| 5,600,350 | 2/1997 | Cobbs | 347/19 |
| 5,600,352 | 2/1997 | Knierim et al. | 347/40 |
| 5,769,550 | 6/1998 | Brand et al. | 347/5 X |
| 5,844,584 | 12/1998 | Murphy, III et al. | 347/20 |
| 5,956,051 | 9/1999 | Davies et al. | 347/19 X |

FOREIGN PATENT DOCUMENTS

| | | |
|---|---|---|
| 0702334 | 3/1996 | European Pat. Off. . |
| 072335 | 3/1996 | European Pat. Off. . |

*Primary Examiner*—Sandra Brase

*Attorney, Agent, or Firm*—Angelo N. Chaclas; Michael E. Melton

[57] ABSTRACT

Mailing machine including a transport apparatus for feeding a mailpiece in a path of travel, a printer module including a first array of print elements and a second array of print elements and a control system in operative communication with the transport means and the printer module. The first array of print elements are positioned substantially transverse to the path of travel for printing a first portion of a postal indicia while the second array of print elements are substantially parallel to the first array of print elements and located downstream in the path of travel from the first array of print elements for printing a second portion of the postal indicia. The control system prints a test pattern on a print medium as the print medium is fed through the mailing machine and stores an indicator of a default time delay based upon the test pattern between energizing the first array of print elements and the second array of print elements so that the first and second portions of the postal indicia are in substantial alignment in a direction transverse to the path of travel.

20 Claims, 7 Drawing Sheets

MAILING MACHINE HAVING REGISTRATION OF MULTIPLE ARRAYS OF PRINT ELEMENTS

FIELD OF THE INVENTION

This invention relates to ink jet printing in a mailing machine. More particularly, this invention is directed to coordinating the print data signals between a pair of ink jet cartridges which are spaced apart so that a first portion of a print image printed by one of the ink jet cartridges is aligned with a second portion of the print imaged printed by the other ink jet cartridge.

BACKGROUND OF THE INVENTION

Ink jet printers are well known in the art. Generally, an ink jet printer includes an array of nozzles or orifices, a supply of ink, a plurality of ejection elements (typically either expanding vapor bubble elements or piezoelectric transducer elements) corresponding to the array of nozzles and suitable driver and control electronics for controlling the ejection elements. Typically, the array of nozzles and the ejection elements along with their associated components are referred to as a print head. It is the activation of the ejection elements which causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed. Recently, the postage meter industry and other envelope printing industries have begun to incorporate ink jet printers having user replaceable ink jet cartridges.

A typical postage meter (one example of a postage printing apparatus) applies evidence of postage, commonly referred to as a postal indicia, to an envelope or other mailpiece and accounts for the value of the postage dispensed. As is well known, postage meters include an ascending register that stores a running total of all postage dispensed by the meter and a descending register that holds the remaining amount of postage credited to the meter and that is reduced by the amount of postage dispensed during a transaction. Because U.S. Postal Service regulations require that postage be paid in advance, it had traditionally been required that the user of a postage meter periodically present the meter to a Postal Service employee for recharging. However, more recently it is possible to recharge a meter remotely using telephone communications. At the time of recharging, the user pays to the Postal Service the amount of postage to be credited to the meter and the meter is recharged by increasing the setting of the descending register by the amount paid. The postage meter generally also includes a control sum register, which provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, the dispensing of postal funds may be accurately tracked and recorded.

Generally, the postage meter may be incorporated into a mailing machine, which is also well known in the art, for automated handling of the mailpieces. Mailing machines are readily available from manufacturers such as Pitney Bowes Inc. of Stamford, Conn., USA and often include a variety of different modules, which automate the processes of producing mailpieces. The typical mailing machine includes a variety of different modules or sub-systems where each module performs a different task on a mailpiece, such as: singulating (separating the mailpieces one at a time from a stack of mailpieces), weighing, sealing (wetting and closing the glued flap of an envelope), applying evidence of postage, accounting for postage used (performed by the postage meter), feeding roll tape or cut tape strips for printing and stacking finished mailpieces. However, the exact configuration of each mailing machine is particular to the needs of the user. Customarily, the mailing machine also includes a transport apparatus, which feeds the mailpieces in a path of travel through the successive modules of the mailing machine.

To achieve increased throughput, it is generally advantageous to print the postal indicia in one pass. In this way, the envelopes can be fed in a continuous fashion past a printer module containing the ink jet printer without stopping or repositioning of the ink jet printer. Unfortunately, the current state of ink jet printing technology only provides for an ink jet print head having an array of nozzles with a small dimension (generally less than 0.50 inches). Thus, a single ink jet cartridge like those commonly available will not be able to print the entire postal indicia in one pass.

One way to attempt to resolve this problem is to cluster multiple ink jet cartridges together so as to extend the effective length of the linear array of nozzles. However, this increases the overall complexity of the system since the firing of the nozzles between the ink jet cartridges must be coordinated so that a quality printed image is produced. This problem is exacerbated by manufacturing tolerances associated with aligning the ink jet cartridges to each other and coordinating the print data signals with the feeding of the mailpiece.

Therefore, there is a need for a mailing machine including a control system and an ink jet printer having a pair of ink jet cartridges that are capable of printing a postal indicia is one pass. More particularly, there is a need for a mailing machine wherein the control system ensures that the print data signals sent to the pair of ink jet cartridges, respectively, are coordinated so as to produce a quality printed postal indicia.

SUMMARY OF THE INVENTION

The present invention provides a mailing machine and method of operating a mailing machine that substantially aligns a first portion of a postal indicia printed by a first array of print elements and a second portion of the postal indicia printed by a second array of print elements.

In accordance with the present invention, there is provided a machine including a transport apparatus for feeding a mailpiece in a path of travel, a printer module including a first array of print elements and a second array of print elements and a control system in operative communication with the transport means and the printer module. The first array of print elements are positioned substantially transverse to the path of travel for printing a first portion of a postal indicia while the second array of print elements are substantially parallel to the first array of print elements and located downstream in the path of travel from the first array of print elements for printing a second portion of the postal indicia. The control system prints a test pattern on a print medium as the print medium is fed through the mailing machine and stores an indicator of a default time delay based upon the test pattern between energizing the first array of print elements and the second array of print elements so that the first and second portions of the postal indicia are in substantial alignment in a direction transverse to the path of travel.

Therefore, it is now apparent that the present invention substantially overcomes the disadvantages associated with the prior art. Additional advantages of the invention will be set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
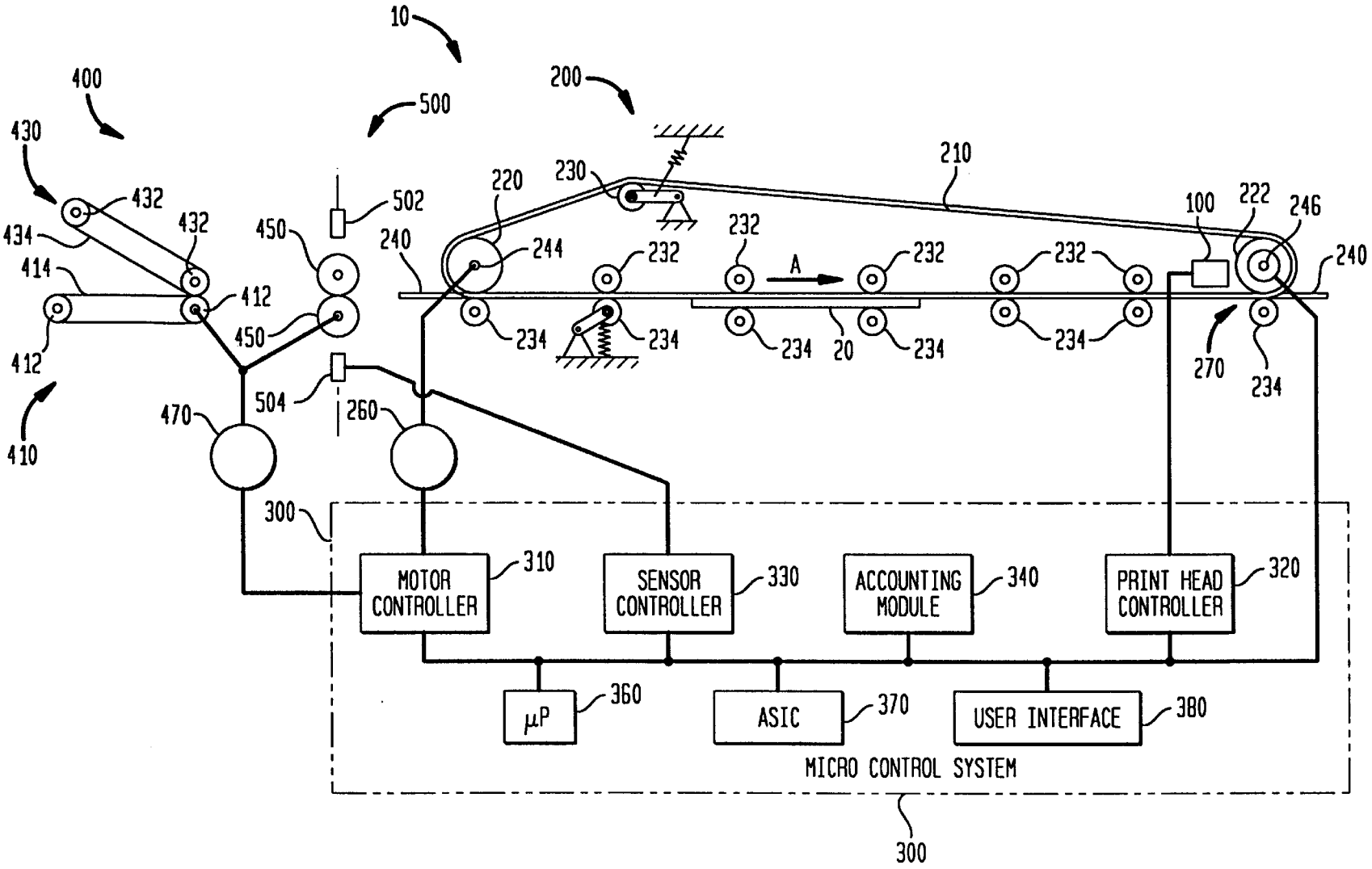
FIG. 1 is a simplified schematic of a front elevational view of a mailing machine, which incorporates the present invention.

Referring to FIG. 1, an example of a mailing machine 10 in which the present invention may be incorporated is shown. The mailing machine 10 includes a printer module 100, a conveyor apparatus 200, a micro control system 300 and a singulator module 400. Other modules of the mailing machine 10, such as those described above, have not been shown for the sake of clarity. The singulator module 400 receives a stack of envelopes (not shown), or other mail-pieces such as postcards, folders and the like, and separates and feeds them in a seriatim fashion (one at a time) in a path of travel as indicated by arrow A. The conveyor apparatus 200 feeds the envelopes 20 in the path of travel along a deck 240 past the printer module 100 so that a postal indicia can be printed on each envelope 20. Together, the singulator module 400 and the conveyor module 200 make up a transport apparatus for feeding the envelopes 20 through the various modules of the mailing machine 10.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410.

Since the details of the singulator module 400 are not necessary for an understanding of the present invention, no further description will be provided. However, an example of a singulator module suitable for use in conjunction with the present invention is described in U.S. Pat. No. 4,978,114, entitled REVERSE BELT SINGULATING APPARATUS, the disclosure of which is specifically incorporated herein by reference.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the takeaway roller drive train so that the take-away rollers 450 operate at a higher speed than the feeder assembly 410 does. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The mailing machine 10 further includes a sensor module 500, which is substantially in alignment with the nip of take-away rollers 450 for detecting the presence of the envelope 20. Preferably, the sensor module 500 is of any conventional optical type, which includes a light emitter, 502 and a light detector 504. Generally, the light emitter 502 and the light detector 504 are located in an opposed relationship on opposite sides of the path of travel so that the envelope 20 passes therebetween. By measuring the amount of light that the light detector 504 receives, the presence or absence of the envelope 20 can be determined. Generally, by detecting the lead and trail edges of the envelope 20, the sensor module 500 provides signals to the micro control system 300 which are used to determine the length of the envelope 20 and measure the gap between successive envelopes 20.

The conveyor apparatus 200 includes an endless belt 210 looped around a drive pulley 220 and an encoder pulley 222 which is located downstream in the path of travel from the drive pulley 220 and proximate to the printer module 100. The drive pulley 220 and the encoder pulley 222 are substantially identical and are fixably mounted to shafts 244 and 246, respectively, which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively. For clarity, only one of the idler pulleys 232 has been shown with the biasing structure.

As described above, the normal force rollers 234 work to bias the envelope 20 up against the deck 240. This is commonly referred to as top surface registration, which is beneficial for ink jet printing. Any variation in thickness of the envelope 20 is taken up by the deflection of the normal force rollers 234. Thus, a constant space is set between the envelope 20 and the printer module 100 no matter what the thickness of the envelope 20. The constant space is optimally set to a desired value to achieve quality printing. It is important to note that the deck 240 contains suitable openings (not shown) for the endless belt 210 and normal force rollers 234.

Figure 3:
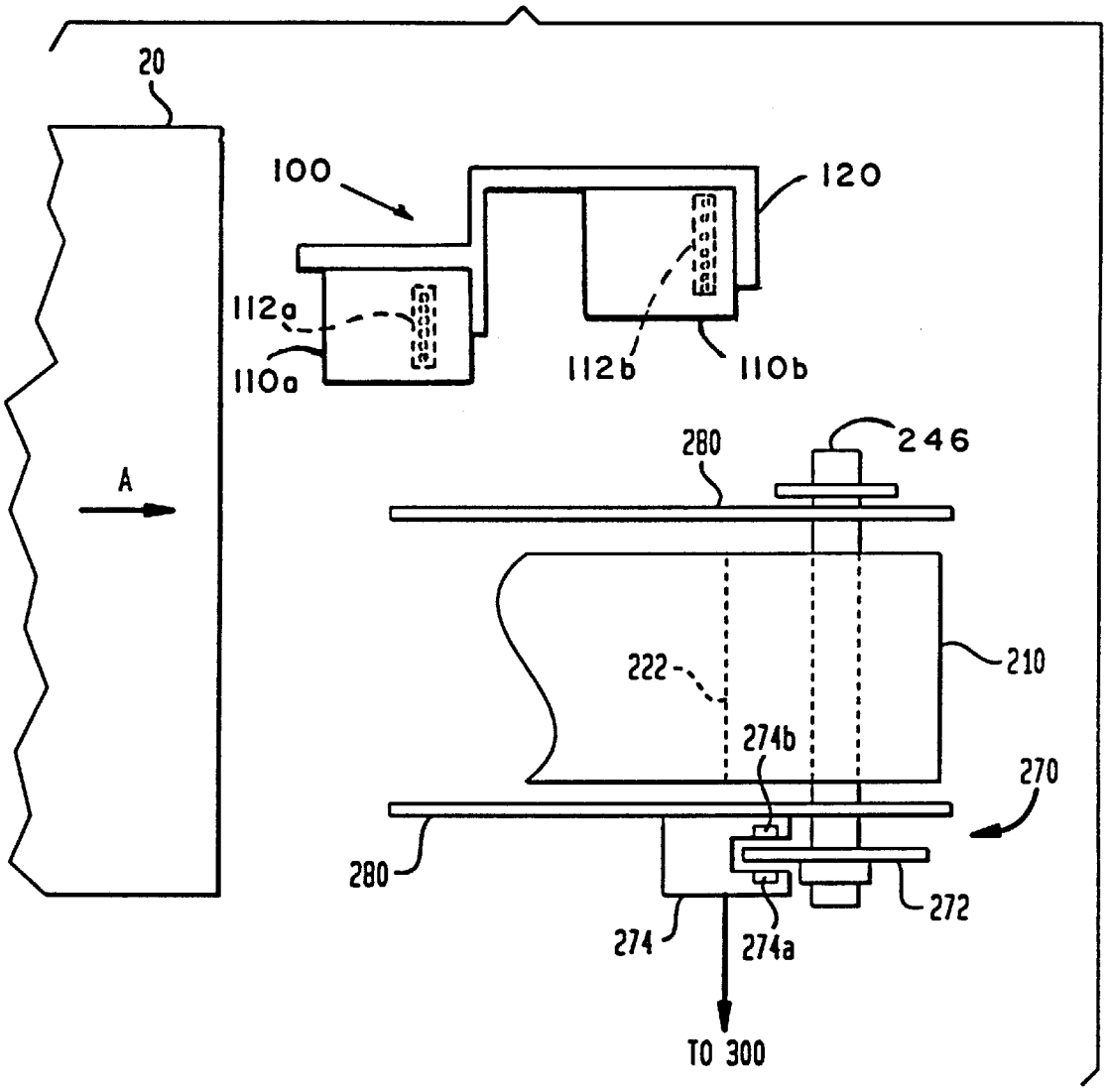
FIG. 3 is a simplified schematic representation of a plan view of a printer module, an encoder pulley and an encoder system in accordance with the invention.

Referring to FIGS. 1 and 3, the conveyor apparatus 200 also includes an encoder system 270, which is located proximate to the printer module 100 and operatively coupled to the encoder pulley 222. The encoder system 270 includes an encoder disk 272 fixably mount to the shaft 246 and an encoder detector 274 fixably mounted to a frame 280. Thus, as the encoder pulley 222 rotates so does the encoder disk 272. The encoder disk 272 has a plurality of vanes located around its circumference and is of a conventional type, such as model number HP 5100 available from Hewlett-Packard Company. The encoder detector 274 is also of conventional type; such as model number HP 9100 available from Hewlett-Packard Company, and includes a light source 274*a* and a light detector 274*b*. The encoder disk 272 and the encoder detector 274 are positioned with respect to each other so that the vanes of the encoder disk 272 alternately block and unblock the light source 274*a* as the shaft 246 rotates. The transition from blocked to unblocked or vice versa results in a change of state or encoder signal (also commonly referred to as a "count") for the encoder detector 274. The encoder disk 272 has been selected so that 1024 counts occur per revolution. In this manner, the position and speed of the shaft 246 can be tracked. This type of encoder system 270 is well known and those skilled in the art will recognize other means for encoding, which would serve equally well.

The combination of the pitch radius of the belt 210 on the encoder pulley 222 is designed to be 0.679 inches so that when coupled with the encoder disk having 1024 vanes per revolution a desired print density of approximately 240 dots per inch (DPI) results. This result is achieved because for every encoder count, the envelope 20 travels approximately 0.0041 inches (easily derived from basic geometric principles). Thus, there is a distance of approximately 0.0041 inches between each line of print. Those skilled in the art will appreciate that, by varying the system geometry and the encoder disk, different print densities may be obtained.

In the preferred embodiment, the printer module 100 includes a carriage 120, a first ink jet cartridge 110*a* having an array of nozzles 112*a* and a second ink jet cartridge 110*b* having an array of nozzles 112*b*, both of which are separately detachably mounted to the carriage 120 by any conventional means. Generally, the distance between the ink jet cartridge 110a and the second ink jet cartridge 110*b* as measured along the path of travel is necessary for packaging considerations. Typically, high performance print heads capable of high resolution printing at high speeds are only available in linear arrays of small length. Thus, to print a wide swath across the envelope 20 requires the alignment of multiple ink jet cartridges in end-to-end fashion as measured in a direction transverse to the path of travel. The use of multiple print heads in this fashion increases the print zone over which accurate encoding needs to take place because encoding must now occur over the print area plus the distance between the ink jet cartridges. Those skilled in the art will recognize that any number of ink jet cartridges can be arranged in this or analogous manners to achieve any desired effective print swath.

Figure 2:
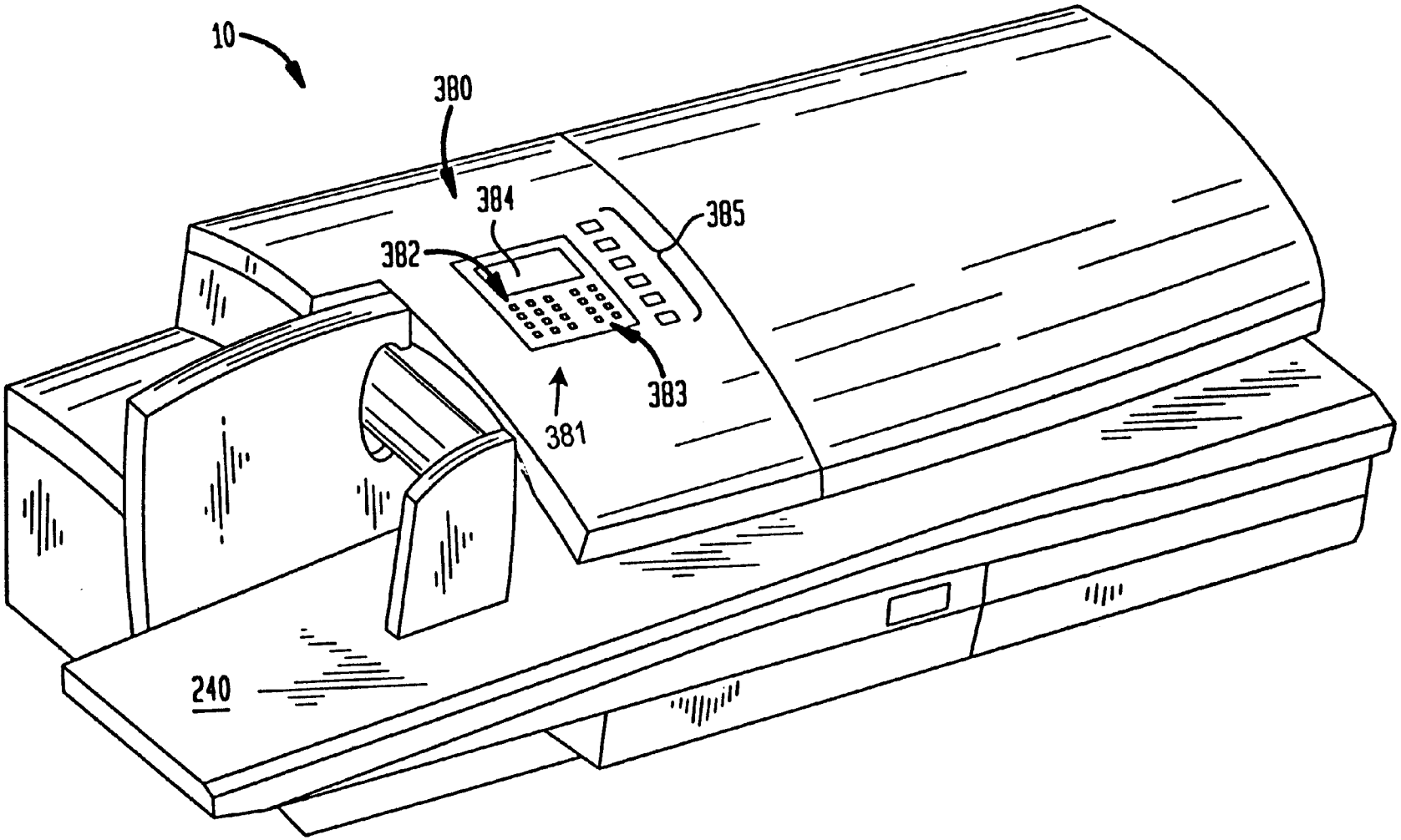
FIG. 2 is a perspective view of the mailing machine in accordance with the present invention.

Referring to FIG. 2, the mailing machine 10 further includes a user interface 380 for providing communication between the operator and the mailing machine 10. The user interface 380 includes a resident display/keyboard 381 having a numeric keypad 382, a set of keys 383 and a display 384 (CRT, LED, LCD or otherwise) and a set of function keys 385. The keys 383 provide access to a set of "soft" commands or functions, such as: enter, clear, download postage, generate report, account setup, diagnostics and the like. By soft commands, it is meant that these commands are not directly related to processing a batch of mailpieces. In contrast, the function keys 385 provide access to a set of "hard" commands, such as: start, stop, print tape, reset batch counter, weigh mode on/off, sealer/moistener mode on/off and the like, which are directly related to processing a batch of mailpieces.

The conveyor apparatus 200, the user interface 380 and the printer module 100 as described above are under the control of the micro control system 300, which may be of any suitable combination of microprocessors, firmware and software. The micro control system 300 includes a motor controller 310 which is in operative communication with the motor 260, a print head controller 320 which is in operative communication with the printer module 100, a sensor controller 330 which is in operative communication with the sensor module 500, an accounting module 340 (postage meter) for tracking postal funds, a microprocessor 360 and a security application specific integrated circuit (ASIC) 370. Additionally, the micro control system 300 is in operative communication with the encoder system 270 via the encoder detector 274. The micro control system 300 constantly compares the actual position of the envelope 20 with the desired position of the envelope 20 and computes appropriate corrective drive signals, which are communicated to the motor controller 310. The motor controller 310 then provides energizing signals to the motor 260 in response to the drive signals received from the micro control system 300. Those skilled in the art will recognize that the various components of the micro control system 300 are in operative communication with each other over conventional communication lines, such as a communication bus.

Referring to FIGS. 1 and 3, the print head controller 320 provides print data signals to the nozzle arrays 112*a* and 112*b* of the print head module 100 in response to instructions from the micro control system 300. As an input, the micro control system 300 receives the counts from the encoder detector 274 as the encoder disk 272 alternately blocks and unblocks the encoder detector 274. At each count, the micro control system 300 instructs the print head controller 320 to energize the nozzle arrays 112*a* and 112*b*, appropriately. Thus, a line of print occurs for each count that takes place during printing.

However, since ink cartridge 110*b* is printing the top half of the postal indicia while ink cartridge 110*a* is printing the bottom half of the postal indicia, the firing of the respective nozzle arrays 112*a* and 112*b* should be coordinated in two directions so that a quality image is produced. Otherwise, an offset or lack of registration will occur between the top and bottom halves of the postal indicia. This issue is complicated by manufacturing tolerances associated with the ink cartridges 110*a* and 110*b*, the carriage 120 and the mechanisms for detachably mounting (not shown) the ink cartridges 110*a* and 110*b* to the carriage 120. Additionally, changes in ambient temperature and accumulations of paper dust on the carriage 120 and the cartridges 110*a* and 110*b* also contribute to uncertainty as to the positioning of the nozzle array 112*a* and the nozzle array 112*b* relative to each other. Thus, the actual distance along the path of travel between the nozzle array 112*a* and the nozzle array 112*b*, as well as the actual distance transverse to the path of travel between the proximate ends of the respective nozzle arrays 112*a* and 112*b*, are not exactly known.

Another factor that complicates the firing of the respective nozzle array 112*a* and 112*b* to achieve a quality printed image is the tolerances associated with the conveyor apparatus 200 and the encoder system 270. Also, any variations in the speed of the envelope 20 could also negatively impact print quality by requiring a different time delay to yield a quality printed image.

Aligning the top half of the postal indicia (printed by the ink cartridge 110*b*) with the bottom half of the postal indicia (printed by the ink cartridge 110*a*) in the direction transverse to the path of travel must also be resolved. Otherwise, a gap between the top and bottom halves of the postal indicia will result if a space exists between where the nozzle array 112*a* of the ink cartridge 110*a* leaves off and the nozzle array 112*b* of the ink cartridge 110*b* begins. On the other hand, the top and bottom halves of the postal indicia will become intermixed if an overlap exists between the nozzle array 112*a* of the ink cartridge 110*a* and the nozzle array 112*b* of the ink cartridge 110*b* as viewed in the direction of the path of travel.

Figure 4:
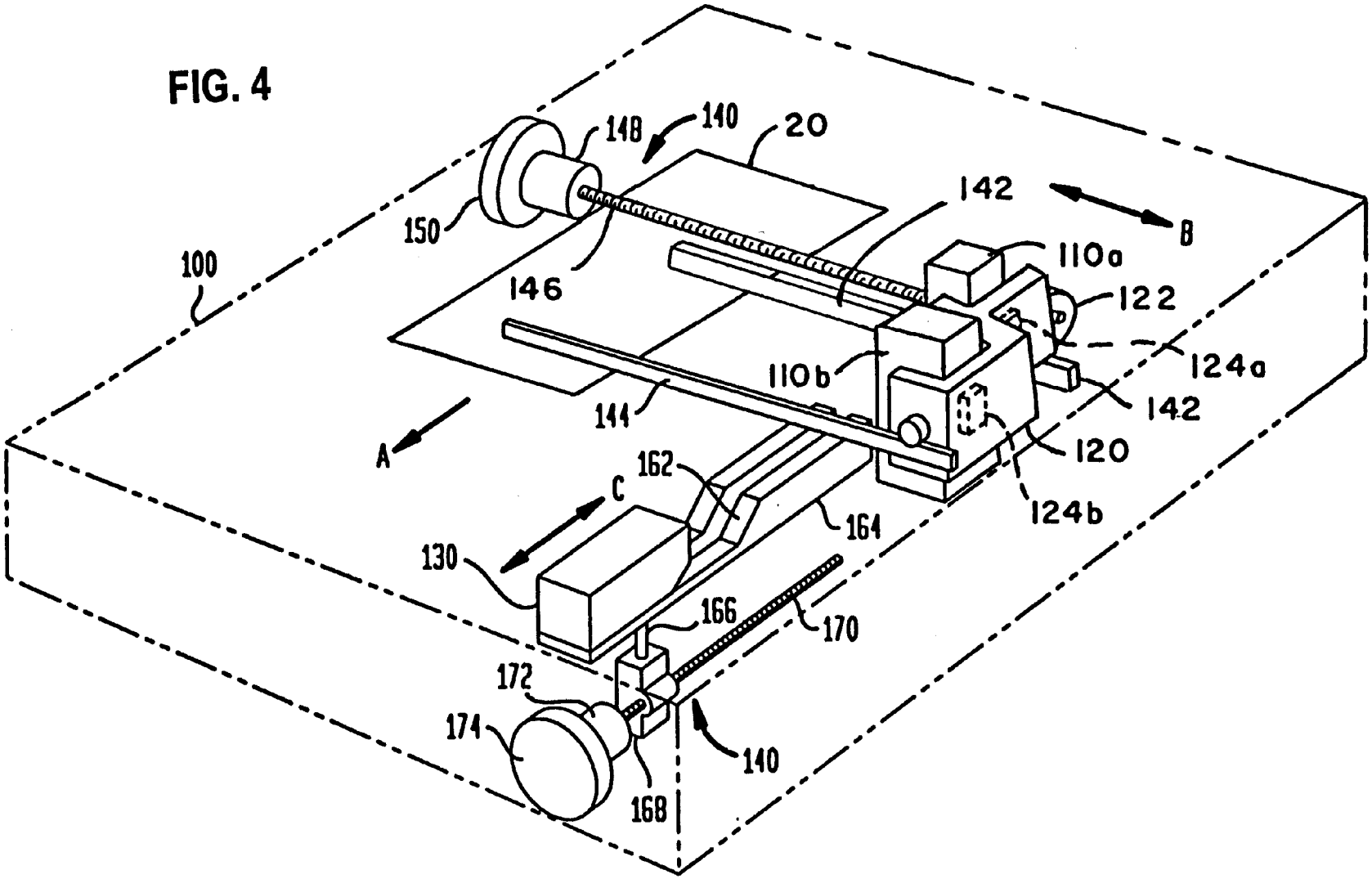
FIG. 4 is a more detailed schematic of a perspective view of the printer module including a pair of print cartridges in accordance with the present invention.

Referring to FIG. 4, a more detailed view of the printer module 100 is shown. The printer module 100 includes the carriage 120, the pair of ink jet cartridges 110*a* and 110*b* each detachably mounted to the carriage 120, a maintenance assembly 130 and an assembly 140 for repositioning the carriage 120 and the maintenance assembly 130 into and out of operative engagement. The ink jet cartridges 110*a* and 110*b* are detachably mounted to connectors 124*a* and 124*b*, respectively, which are in turn fixably mounted to the carriage 120. Print data signals are supplied to the ink jet cartridges 110*a* and 110*b* from the print head controller 320 via the connectors 124*a* and 124*b*, respectively. The maintenance assembly 130 operates to wipe and cap the cartridges 110*a* and 110*b* in conventional fashion. The printer module 100 further includes suitable framework (not shown) for supporting the various components of the printer module 100.

The printer module 100 is used for printing a postal indicia on the envelope 20, which travels in the direction indicated by the arrow A. The repositioning assembly 140 includes a pair of rails 142 and 144, respectively, on which the carriage 120 rests. A lead screw 146 is driven by a drive motor 148 and threadingly engages a nut 122 fixably attached to the carriage 120 in order to translate the carriage 120 back and forth along the rails 142 and 144 as indicated by a double sided arrow B. A conventional encoder system 150 is operatively connected to the drive motor 148 for providing signals indicative of the position of the carriage 120 along the lead screw 146. The carriage 120 can be stopped at various positions along the lead screw 146 depending upon whether the cartridges 110*a* and 110*b* are printing or engaged with the maintenance assembly 130.

The repositioning assembly 140 further includes suitable structure for repositioning the maintenance assembly 130. The maintenance assembly 130 travels along a track 164 having a camming surface 162 as indicated by a double-sided arrow C. A pin 166 engages an aperture (not shown) in the maintenance assembly 130 to reposition the maintenance assembly 130 along the track 164. The pin 166 is seated in a block 168, which threadingly engages a lead screw 170, which in turn is driven by a drive motor 172. Additionally, a conventional encoder system 174 is operatively connected to the drive motor 172 for providing signals indicative of the position of the maintenance assembly 130 along the lead screw 170. The maintenance assembly 130 can be stopped at various positions along the lead screw 170 depending upon whether the cartridges 110*a* and 110*b* are printing or engaged with the maintenance assembly 130.

Figure 5:
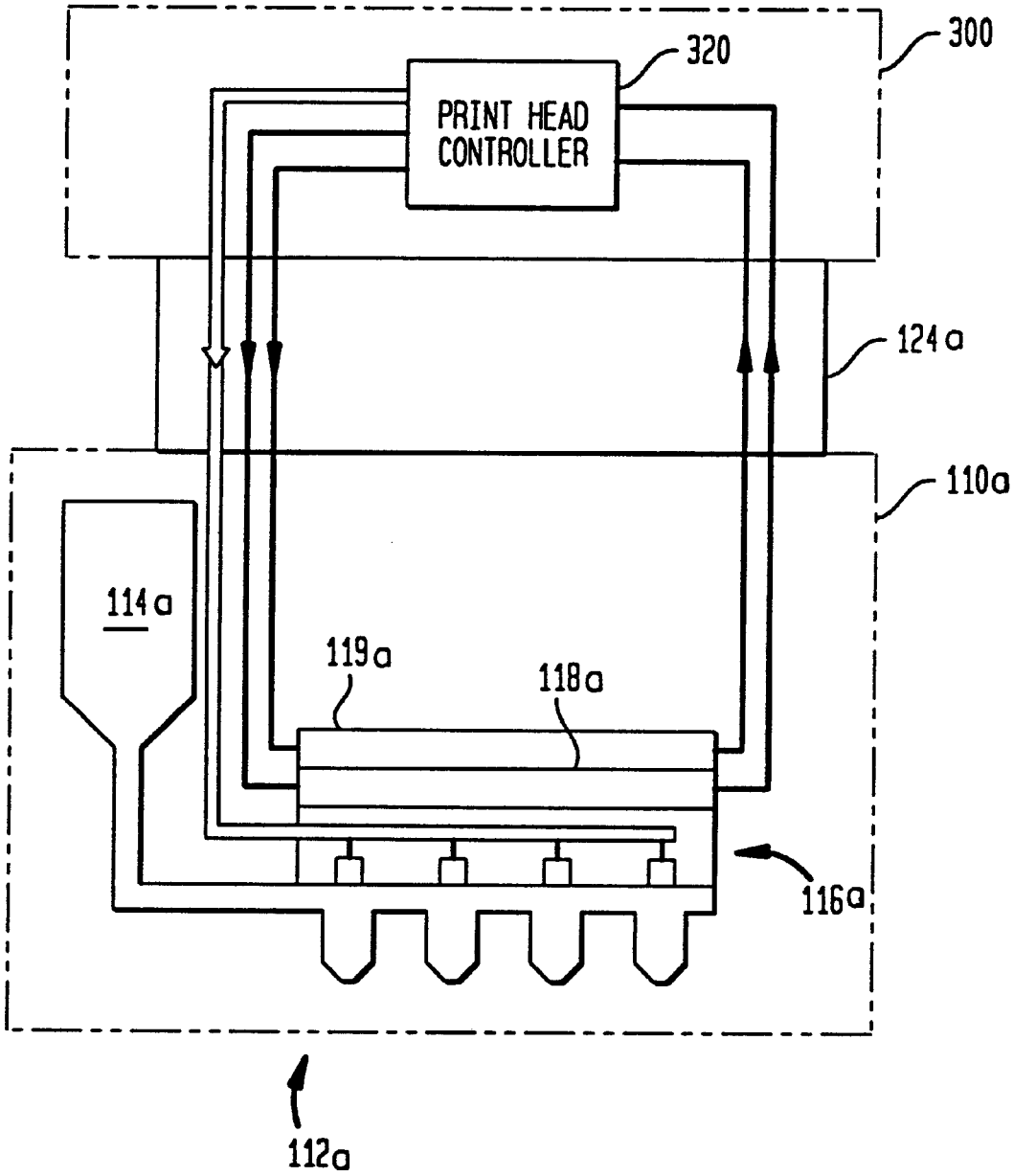
FIG. 5 is a more detailed schematic of one of the pair of print cartridges in accordance with the present invention.

Referring to FIG. 5, a more detailed view of the ink jet cartridge 110*a* is shown. Since ink jet cartridge 110*b* is substantially identical, only one detailed view is necessary. The ink jet cartridge 110*a* includes the array of nozzle array 112*a*, a supply of ink 114*a* and a plurality of ejection elements 116*a* connecting the array of nozzles 112*a* with ink 114*a*, respectively. Activation of each of the ejection elements 116*a* is selectively controlled by suitable print data signals provided by the print head controller 320 which cause ink 114*a* to be expelled from the array of nozzles 112*a* in a predetermined manner. In the preferred embodiment, the plurality of ejection elements 116*a* are bubble jet type elements. The ink jet cartridge 110*a* further includes feed back devices in the form of a diode 118*a* and a resistor 119*a* which provide calibration information to the print head controller 320 as to the operating conditions of the cartridge 110*a*. Since the diode 11 8a has a known operating behavior with respect to temperature, by applying a known voltage to the diode 118*a* and measuring the corresponding output current, the print head controller 320 can calculate the ambient temperature. In similar fashion, by applying a known voltage to the resistor 119*a* and measuring the corresponding output current, the print head controller 320 can calculate the sensitivity of the resistor 119*a* (sometimes referred to as an inherent resistor or a rank resistor). Both the ambient temperature and the resistor sensitivity are calibration inputs which are used to optimize the print data signals supplied to the ejection elements 116*a* to produce quality printed images. In the preferred embodiment, there is one diode 118*a* and one resistor 119*a* mounted directly to the silicone substrate which comprises the ejection elements 116*a*. Those skilled in the art will recognize that each one of the ejection elements 116*a* could have its own diode and resistor or that the ejection elements 116*a* could be grouped into functional blocks with each block having its own diode and resistor.

Figure 6A:
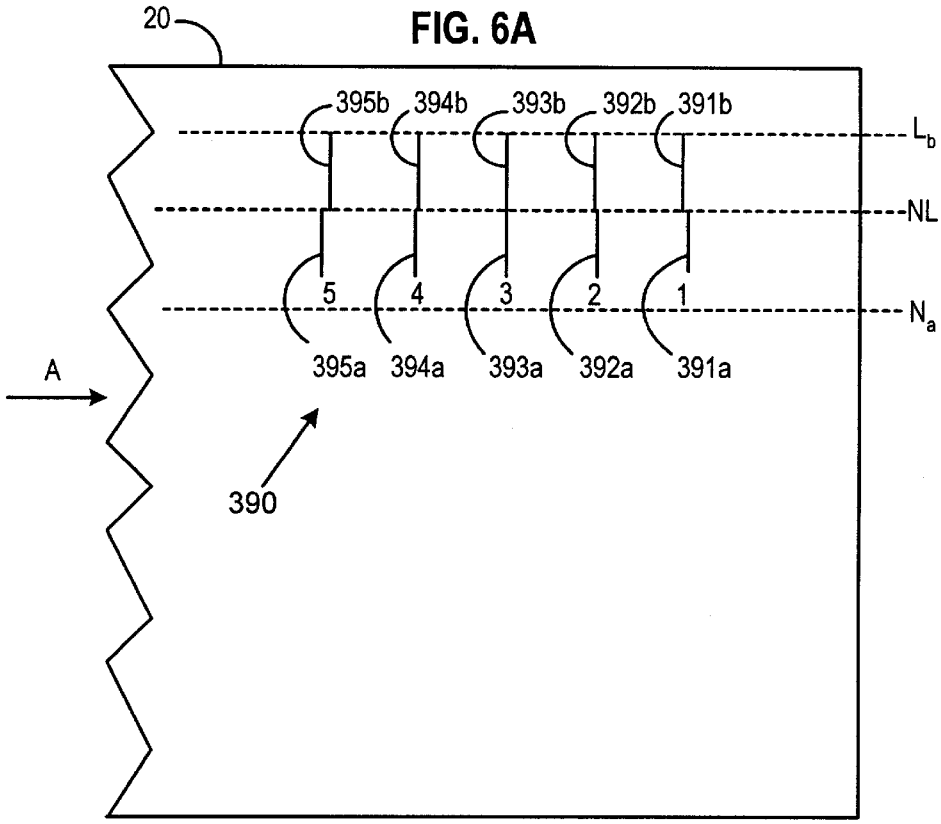
FIG. 6A is a plan of an envelope having a first test pattern printed thereon in accordance with the present invention.

Referring to FIG. 6A in view of FIG. 3, a first test pattern 390 printed on the envelope 20 is shown. The test pattern 390 includes a plurality of vertical lines 391*a*–395*a* printed by the cartridge 110*a* and a plurality of corresponding vertical lines 391*b*–395*b* printed by the cartridge 110*b*. The plurality of vertical lines 391*a*–395*a* are printed with uniform spacing. On the other hand, the plurality of vertical lines 391*b*–395*b* are printed with non-uniform or variable spacing as measured from their corresponding plurality of vertical lines 391*a*–395*a*, respectively. The range over which cartridge 110*a* prints is defined by the zone between dashed lines La and NL while the range over which cartridge 110*b* prints is defined by the zone between dashed lines Lb and NL. Thus, dashed line NL represents the knit line where the two print zones meet. Additionally, in the preferred embodiment, the cartridge 110*a* prints a plurality of reference numbers 1–5 associated with each of the plurality of vertical lines 391*a*–395*a* and their plurality of corresponding vertical lines 391*b*–395*b*, respectively.

Since the cartridge 110*a* is up stream in the path of travel from the cartridge 110*b*, the plurality of vertical lines 391*a*–395*a* are printed before their corresponding plurality of vertical lines 391*b*–395*b*. Therefore, a timing delay in the firing sequence must be introduced. However, because the actual distance along the path of travel between the nozzle array 112*a* and the nozzle array 112*b* is varied due to the reasons set forth above, there is a risk of misalignment between the portion of the postal indicia printed by the cartridge 110*a* and the portion printed by the cartridge 110*b*.

Referring to FIG. 2 and 6A, to compensate for this problem, the plurality of vertical lines 391*b*–395*b* are printed with different time delays from their corresponding plurality of vertical lines 391*a*–395*a* so that a preferred time delay that yields the highest quality printed image may be determined. In the preferred embodiment, the time delays are measured in encoder counts from the encoder system 270 of the conveyor apparatus 200. With respect to vertical line 393*b*, a nominal encoder count is selected to accommodate the nominal dimensions of the cartridges 110*a* and 110*b*, the locking mechanisms (not shown) and the carriage 120 as designed. On the other hand, the encoder counts for vertical lines 391*b* and 392*b* are selected to be less than the nominal encoder count with the encoder count for vertical line 391*b* being less than the encoder count for vertical line 392*b*. In analogous fashion, the encoder counts for vertical lines 394*b* and 395*b* are selected to be greater than the nominal encoder count with the encoder count for vertical line 395*b* being greater than the encoder count for vertical line 394*b*. In this way, a range of encoder counts on either side of the nominal encoder count are used.

Figure 6B:
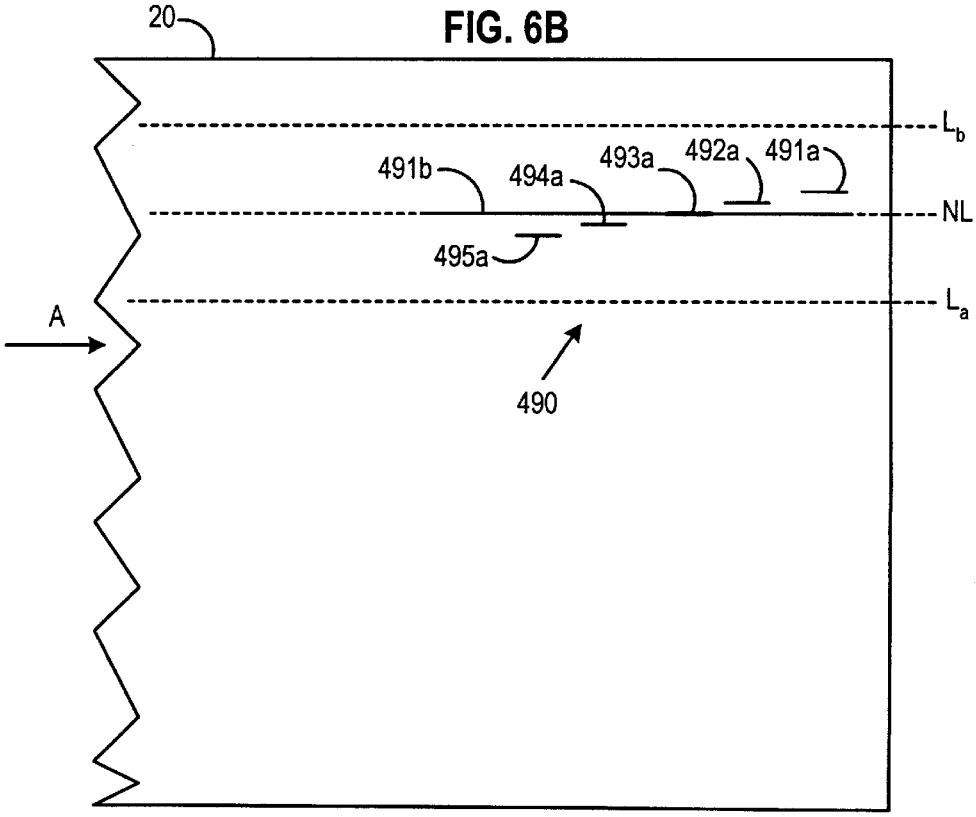
FIG. 6B is a plan of an envelope having a second test pattern printed thereon in accordance with the present invention.

Referring to FIG. 6B in view of FIG. 3, a second test pattern 490 printed on the envelope 20 is shown. The test pattern 490 includes a plurality of horizontal lines 491*a*–495*a* printed by the cartridge 110*a* and a corresponding elongated horizontal line 491*b* printed by the cartridge 110*b*. The plurality of horizontal lines 491*a*–495*a* are printed in spaced apart relationship on the envelope 20 in the path of travel. Line 491*a* is printed by a top most nozzle of the nozzle array 112*a*, while line 492*a* is printed by a second from the top nozzle of the nozzle array 112*a*, and so on. On the other hand, the corresponding elongated horizontal line 491*b* is printed with a bottom most nozzle of the nozzle array 112*b*. The range over which cartridge 110*a* prints is defined by the zone between dashed lines La and NL while the range over which cartridge 110*b* prints is defined by as the zone between dashed lines Lb and NL. Thus, dashed line NL represents the knit line where the two print zones meet. Additionally, in the preferred embodiment, the cartridge 110*a* prints a plurality of reference numbers 1–5 associated with each of the plurality of horizontal lines 491*a*–495*a*.

Since the cartridge 110*a* is generally aligned end-to-end in the direction transverse to the path of travel from the cartridge 110*b*, there is a risk of poor registration between the nozzle array 112*a* and 112*b*. Therefore, a purposeful overlap has been designed into the system geometry so that under nominal conditions 3 nozzles from the nozzle array 112*a* overlap with those of the nozzle array 112*b*. Thus, the second test pattern 491 assists in determining how many nozzles will be disabled. In the example shown, since horizontal line 493*a* is closest to (shown on top of) elongate horizontal line 491*b*, the top three nozzles of nozzle array 112*a* will be disabled.

Figure 7A:
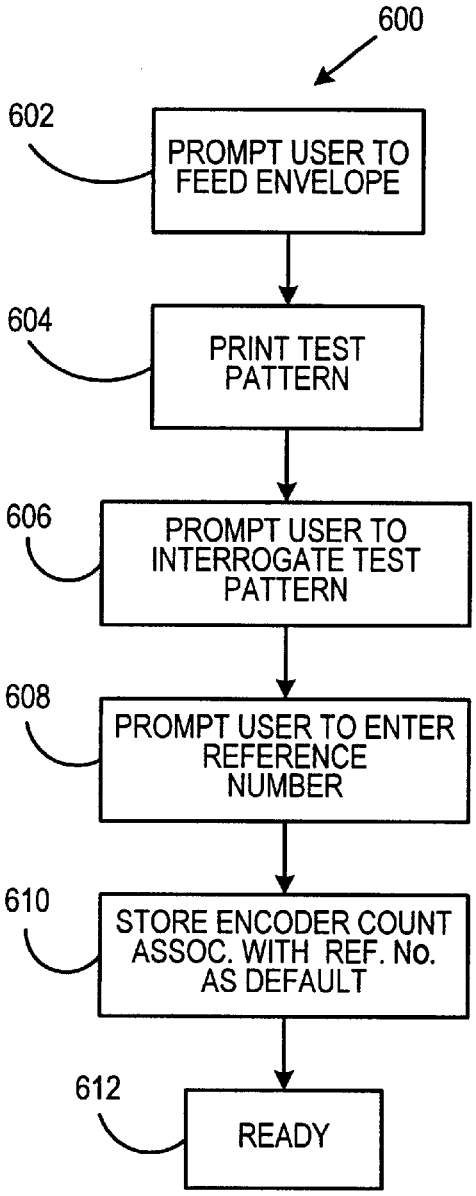
FIG. 7A is a flow chart of a horizontal alignment routine summarizing the operation of the mailing machine in accordance with the present invention.

With the structure of the mailing machine 10 described as above, the operational characteristics will now be described. Referring primarily to FIG. 7A, while referencing the structure of FIGS. 1, 2, 3, 5, and 6A, a flow chart of a horizontal routine 600 summarizing the operation of the mailing machine 10 in accordance with the present invention is shown. To establish a default encoder count to be used as the timing delay for cartridge 110*b* when printing the postal indicia, the operator's input is utilized. At 602 before the mailing machine 10 will print a postal indicia, the operator is prompted via the display 384 to feed a blank envelope 20 or other suitable print medium through the mailing machine 10. That is, in the preferred embodiment the operator is forced to complete the horizontal routine 600 before being allowed to process mailpieces. Next, at 604, the printer module 100 will print the test pattern 390 on the blank envelope 20 as it is fed through the mailing machine 10. Next, at 606, the operator is prompted via the display 384 to retrieve the blank envelope 20 and interrogate the test pattern 390. Next, at 608, the operator is prompted via the display 384 to input a reference number associated with the grouping of vertical lines: (i) 391*a* and 391*b*, (ii) 392a and 392*b*, (iii) 393*a* and 393*b*, (iv) 394*a* and 394*b* or (v) 395*a* and 395*b* where the alignment is the best. Next, at 610, after operator entry of the reference number, the micro control system 300 stores the encoder count associated with the entered reference number as the default encoder count to be used during printing of subsequent postal indicias. Next, at 612, the mailing machine is ready to process mailpieces.

In the preferred embodiment, the horizontal routine 600 is run at system power up. However, there are other instances when running the horizontal routine 600 may be appropriate. For example, the horizontal routine 600 may be run at the beginning of each batch of mailpieces and/or after a predetermined number, such as 1000, of mailpieces has been processed. As another example, the horizontal routine 600 may be run at the request of the operator at any time.

As still another example, the horizontal routine 600 may be run every time the cartridges 110*a* and 110*b* are replaced with fresh cartridges or merely taken out and reinstalled in the carriage 120. This may be accomplished using the rank resistor 119*a* to detect when the cartridge 110*a* has been removed from the carriage 120. This determination is made prior to printing the postal indicia and also prior to feeding the envelope 20 in the path of travel and may be achieved by constantly applying a predetermined voltage to the resistor 119*a* and measuring the corresponding output current. From this information the micro control system 300 can determine if an ink jet cartridge 110*a* is installed and also calculate the resistance of the resistor 119*a* that is present. If the determined resistance of the resistor 119*a* is within a predetermined range, then the micro control system 300 will determine that the ink jet cartridge 110*a* is present. If the determined resistance of the resistor 119*a* is not within a predetermined range, then the micro control system 300 will determine that the ink jet cartridge 110*a* has been removed. The presence of cartridge 110*b* may be determined in the same manner. Once it has been determined that one or both of the cartridges 110*a* and 110*b* have been removed. The operator is prompted to install new cartridges and once they are detected, horizontal routine 600 will be run. Those skilled in the art will recognize that other techniques for determining if an ink jet cartridge 110 is installed are available, such as providing a conventional interlock switch (not shown) on the mechanisms for detachably mounting the cartridges to the carriage 120 or a proximity sensor (not shown).

As yet another example, the horizontal routine 600 may be run when the print head controller 320 detects a change in ambient temperature above a threshold value. Using the diode 118*a*, the ambient temperature of the cartridge 110*a* when a first test pattern is printed can determined as described above. This ambient temperature can be stored and then compared with a current ambient temperature taken at a later point in time (every envelope, start of batch run, or other desired time). If the difference between the current ambient temperature and the stored ambient temperature is greater than a threshold value, for example 25 degrees Celsius, then the micro control system 300 ceases processing of envelopes 20 and runs the horizontal routine 600.

Figure 7B:
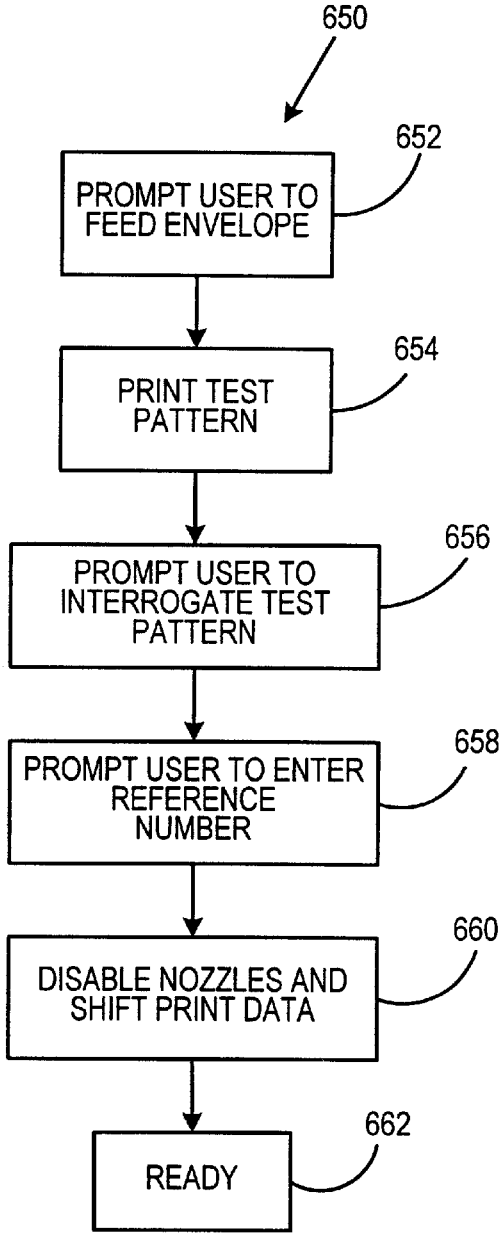
FIG. 7B is a flow chart of a vertical alignment routine summarizing the operation of the mailing machine in accordance with the present invention.

Referring primarily to FIG. 7B, while referencing the structure of FIGS. 1, 2, 3, 5, and 6A, a flow chart of a vertical routine 650 summarizing the operation of the mailing machine 10 in accordance with the present invention is shown. To establish a number of nozzles to be disabled from the nozzles array 112*a* when printing the postal indicia, the operator's input is utilized. At 652 before the mailing machine 10 will print a postal indicia, the operator is prompted via the display 384 to feed a blank envelope 20 or other suitable print medium through the mailing machine 10. That is, in the preferred embodiment the operator is forced to complete the vertical routine 650 before being allowed to process mailpieces. Next, at 654, the printer module 100 will print the second test pattern 490 on the blank envelope 20 as it is fed through the mailing machine 10. Next, at 656, the operator is prompted via the display 384 to retrieve the blank envelope 20 and interrogate the second test pattern 490. Next, at 658, the operator is prompted via the display 384 to input a reference number associated with the one of the plurality of horizontal lines 491*a*–495*a* that is closest to the elongate horizontal line 491*b*. Next, at 660, after operator entry of the reference number, the micro control system 300 disables the corresponding number of nozzles from nozzle array 112*a* and appropriately shifts the print data associated with the nozzles array 112*a* during printing of subsequent postal indicias. Next, at 662, the mailing machine is ready to process mailpieces.

Those skilled in the art will recognize that the vertical routine 650 may be employed along similar lines as those discussed above with respect to the horizontal routine 600. Additionally, it should be apparent that the vertical routine 650 and the horizontal routine 600 are separate and distinct. That is, they may be run independently or in conjunction with each other.

Based on the above description and the associated drawings, it should now be apparent that the present invention substantially overcomes the problems associated with registering the print images from a first array of nozzles that are spaced apart in the path of travel from a second array of nozzles. Importantly, by using the encoder counts as the indicator of the default time delay, variations in the feed speed of the envelope 20 that might otherwise negatively influence print quality if the default time delay were based upon absolute time are automatically compensated for.

Many features of the preferred embodiment represent design choices selected to best exploit the inventive concept as implemented in a mailing machine utilizing individual bubble jet ink cartridges. However, those skilled in the art will recognize that the concepts of the present invention are applicable to a single print head design where the nozzle arrays are spaced apart.

Moreover, those skilled in the art will recognize that various modifications can be made without departing from the spirit of the present invention. For example, the preferred embodiments are described with respect to bubble jet technology, however, those skilled in the art will readily be able to adapt the inventive concepts to piezoelectric technology and a repackaging of the components that embody the ink jet printing apparatus.

Therefore, the inventive concept in its broader aspects is not limited to the specific details of the preferred embodiments but is defined by the appended claims and their equivalents.

What is claimed is:

1. A mailing machine comprising:

transport means for feeding a mailpiece in a path of travel;

a printer module including a first array of print elements positioned substantially transverse to the path of travel for printing a first portion of a postal indicia and a second array of print elements substantially parallel to the first array of print elements and located downstream in the path of travel from the first array of print elements for printing a second portion of the postal indicia; and control means in operative communication with the transport means and the printer module for:

printing a test pattern on a print medium as the print medium is fed through the mailing machine; and storing an indicator of a default time delay based upon the test pattern between energizing the first array of print elements and the second array of print elements so that the first and second portions of the postal indicia are in substantial alignment in a direction transverse to the path of travel;

and wherein:

the test pattern includes a first plurality of lines that are printed by the first array of print elements and are transverse to the direction of travel and a second plurality of lines corresponding to the first plurality of lines that are printed by the second array of print elements, each of the second plurality of lines printed with a respective time delay; and the control means sets the default time delay equal to the respective time delay associated with a particular one of the second plurality of lines that is closest in alignment in a direction transverse to the path of travel with the corresponding one of the first plurality of lines.

2. The mailing machine of claim 1, wherein:

the control means prints the test pattern in response to a predetermined event.

3. The mailing machine of claims 2, further comprising:

means in operative communication with the control means for detecting the presence of the first and second arrays of print elements; and wherein:

the first and second arrays of print elements are detachably mounted to the mailing machine; and the predetermined event is the absence of at least one of the first and second arrays of print elements.

4. The mailing machine of claim 3, wherein:

transport means includes an encoder means for producing a count indicative of an amount of travel of the mailpiece in the direction of travel; and the default time delay is expressed as a number of counts.

5. The mailing machine of claim 4, wherein:

the control means includes a user interface having a display means and an input means; and the control means directs a message to the user interface prompting an operator to feed the print medium so that the test pattern may to be printed.

6. The mailing machine of claim 5, wherein:

the control means directs another message to the user interface after printing the test pattern prompting the operator to enter via the input means an indication of the particular one of the second plurality of lines that is closest in alignment in the direction transverse to the path of travel with the corresponding one of the first plurality of lines so that the default time delay may be set.

7. The mailing machine of claim 1, wherein:

the control means includes a user interface having a display means and an input means; and the control means directs a message to the user interface prompting an operator to feed the print medium so that the test pattern may be printed.

8. The mailing machine of claim 7, wherein:

the control means directs another message to the user interface after printing the test pattern prompting the operator to enter via the input means an indication of the particular one of the second plurality of lines that is closest in alignment in the direction transverse to the path of travel with the corresponding one of the first plurality of lines so that the default time delay may be set.

9. The mailing machine of claim 1, wherein:

the control means prints the test pattern in response to a predetermined event.

10. The mailing machine of claim 9, further comprising:

means in operative communication with the control means for detecting the presence of the first and second arrays of print elements; and wherein:

the first and second arrays of print elements are detachably mounted to the mailing machine; and the predetermined event is the absence of at least one of the first and second arrays of print elements.

11. A method of operating a mailing machine, comprising the step(s) of:

feeding a mailpiece in a path of travel;

providing a printer module including a first array of print elements positioned substantially transverse to the path of travel for printing a first portion of a postal indicia and a second array of print elements substantially parallel to the first array of print elements and located downstream in the path of travel from the first array of print elements for printing a second portion of the postal indicia;

printing a test pattern on a print medium as the print medium is fed through the mailing machine, the test pattern including a first plurality of lines that are printed by the first array of print elements and are transverse to the direction of travel and a second plurality of lines corresponding to the first plurality of lines that are printed by the second array of print elements, each of the second plurality of lines printed with a respective time delay;

storing an indicator of a default time delay based upon the test pattern between energizing the first array of print elements and the second array of print elements so that the first and second portions of the postal indicia are in substantial alignment in a direction transverse to the path of travel; and setting the default time delay equal to the respective time delay associated with a particular one of the second plurality of lines that is closest in alignment in a direction transverse to the path of travel with the corresponding one of the first plurality of lines.

12. The method of claim 11, further comprising the step(s) of:

printing the test pattern in response to a predetermined event.

13. The mailing machine of claim 12, further comprising the step(s) of:

detecting the presence of the first and second arrays of print elements; and wherein:

the first and second arrays of print elements are detachably mounted to the mailing machine; and the predetermined event is the absence of at least one of the first and second arrays of print elements.

14. The method of claim 13, further comprising the step(s) of:

producing an encoder count indicative of an amount of travel of the mailpiece in the direction of travel; and expressing the default time delay as a number of encoder counts.

15. The method of claim 14, further comprising the step(s) of:

directing a message to a user interface having a display means and an input means prompting an operator to feed the print medium so that the test pattern may be printed.

16. The method of claim 15, further comprising the step(s) of:

directing another message to the user interface after printing the test pattern prompting the operator to enter via the input means an indication of the particular one of the second plurality of lines that is closest in alignment in the direction transverse to the path of travel with the corresponding one of the first plurality of lines so that the default time delay may be set.

17. The method of claim 11, further comprising the step(s) of:

directing a message to a user interface having a display means and an input means prompting an operator to feed the print medium so that the test pattern may be printed.

18. The method of claim 17, further comprising the step(s) of:

directing another message to the user interface after printing the test pattern prompting the operator to enter via the input means an indication of the particular one of the second plurality of lines that is closest in alignment in the direction transverse to the path of travel with the corresponding one of the first plurality of lines so that the default time delay may be set.

19. The method of claim 11, further comprising the step(s) of:

printing the test pattern in response to a predetermined event.

20. The mailing machine of claim 19, further comprising the step(s) of:

detecting the presence of the first and second arrays of print elements; and wherein:

the first and second arrays of print elements are detachably mounted to the mailing machine; and the predetermined event is the absence of at least one of the first and second arrays of print elements.

* * * * *